United States Patent [19]

Krambrock et al.

[11] Patent Number: 4,715,951

[45] Date of Patent: Dec. 29, 1987

[54] APPARATUS FOR SEPARATING GRANULATE MATERIAL

[75] Inventors: Wolfgang Krambrock; Hans Hoppe, both of Aichwiesen, Fed. Rep. of Germany

[73] Assignee: Waeschle Maschinenfabrik GmbH, Ravensburg, Fed. Rep. of Germany

[21] Appl. No.: 921,887

[22] Filed: Oct. 21, 1986

Related U.S. Application Data

[63] Continuation of Ser. No. 711,472, Mar. 13, 1985, abandoned.

[30] Foreign Application Priority Data

Mar. 16, 1984 [DE] Fed. Rep. of Germany ..... 3409814

[51] Int. Cl.[4] ..... B07B 7/02

[52] U.S. Cl. ..... 209/138; 209/143

[58] Field of Search ..... 209/138, 140, 141, 142, 209/143, 139.1

[56] References Cited

U.S. PATENT DOCUMENTS

| | | | |
|---|---|---|---|
| 884,551 | 4/1908 | Wright | 209/137 X |
| 940,469 | 11/1909 | Middleton | 209/138 |
| 977,697 | 12/1910 | Balcon | 209/142 X |
| 2,048,613 | 7/1936 | McKee | 209/143 |
| 2,051,567 | 8/1936 | McGee | 209/143 X |
| 2,729,330 | 1/1956 | Newirth | 209/138 |
| 2,737,294 | 3/1956 | McClure | 209/138 |
| 2,766,880 | 9/1956 | Schaub et al. | 209/138 |
| 4,528,092 | 7/1985 | Krambrock et al. | 209/138 X |

FOREIGN PATENT DOCUMENTS 1905106 8/1970 Fed. Rep. of Germany .

*Primary Examiner*—S. Leon Bashore
*Assistant Examiner*—Thomas M. Lithgow
*Attorney, Agent, or Firm*—Murray Schaffer

[57] ABSTRACT

A counterflow separator is provided having a feed pipe for bulk material opening into the top of a chamber housing. A discharge conduit radial extends from the top of the housing and an inlet conduit for classifying air extends radially into the housing at its lower portion. The housing is provided with a wall section below the orifice of the feed pipe, which section expands conically outwardly into a collecting hopper. The conical wall section permits the design of a braking stretch longer than its own length, thus reducing the requirement for classifying air, without causing a deterioration in the classifying quality.

3 Claims, 1 Drawing Figure

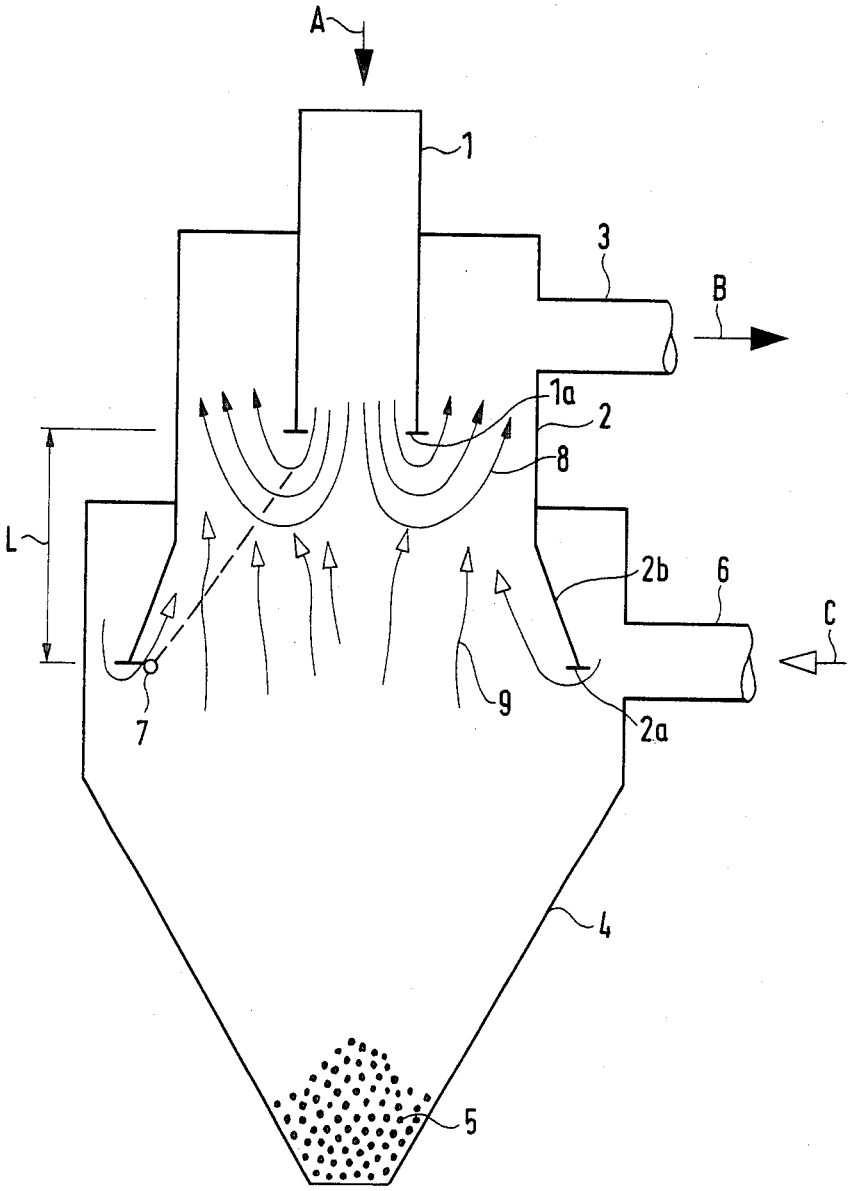
A
1
3
B
1a
2
8
L
2b
6
C
7
9
2a
4
5

APPARATUS FOR SEPARATING GRANULATE MATERIAL

This is a continuation of application Ser. No. 711,472, filed Mar. 13, 1985, now abandoned.

BACKGROUND OF THE INVENTION

The present invention relates to apparatus for separating fine and coarse particles from each other and in particular to a counter-flow pneumatic separator of loose granulate or particulate matter.

In general, pneumatic separators comprise a vertical feed pipe for bulk granulate or particulate material which is fed into the top end of a separating chamber defined by a housing provided at its upper end with a discharge conduit and at its lower end with an air feed conduit, providing air under selected pressure in an upward direction.

Such a counterflow separator is known from the German DE-OS 19 05 106. With it, bulk material is classified, i.e. separated, without prior handling directly from the feed pipe. Since the sifting or separating air flows countercurrent to the bulk graunulate or particulate mixture, great relative speeds result between the certain components of the mixture and the classifying air, leading to correspondingly large tear-off or stress forces which will safely separate dust particles adhering to granulates, pellets etc. This separation occurs in the area between the opening mouth or orifice of the feed pipe in the chamber and the housing's opening at its lower end which leads into a collecting vessel arranged below it. This area is termed the braking stretch and the fine material is braked there by the classifying counter flowing air current and, with reversal of its direction of movement, carried upward by the combining currents of the delivery and classifying air by way of the annular clearance between the part of feed pipe projecting into the chamber and the housing wall and discharged through the discharge conduit.

The particle size, up to which the fine material is separated, is determined by two factors, namely on the one hand by the velocity of the classifying air, and on the other hand, by the length of the braking stretch. Although, as detailed studies have shown, a long braking stretch is desirable in principle because it reduces the necessary amount, and speed of the classifying air and therefore the energy required for the separation, the length of the usually cylindrical braking stretch in the known countercurrent classifier is limited. This limitation is created by the requirement that not only does the course of the particles of fine material have to be changed in such countercurrent separation, but that the particles of coarse material too, entering at first in the axially moving current, experience a certain degree of lateral deflection leading to the movement of the stream of coarse material from the vertical path given it as it exits from the material feed pipe. This deflection has the effect of causing the impact of particles of coarse material on the housing wall, the number of such impacting particles increasing with the increase in length of the braking stretch. As a result, the impacted particles lose so much kinetic energy that they are caused to be carried out through the fine discharge conduit with the countercurrent air composed of the incoming classifying and delivery air, thus causing the fine material to contain an inadmissibly high share of coarse material.

The invention is based on the task of reducing the amount of classifying air and energy required with a countercurrent separator of the type described at the outset, while maintaining the classifying quality the same.

These objects as well as others will be apparent from the following disclosure of the present invention.

SUMMARY OF THE INVENTION

This task has been solved pursuant to the present invention by providing a separator in which the housing, defining the separating chamber, is provided with a wall section below the orifice of the material feed pipe, which wall section expands cone-shaped outwardly in a direction of its opening into the collecting vessel. The conical wall section is preferably approximately one half the braking stretch, and has a conical angle of approximately 20–30 degrees.

Full details of the present invention are set forth in the following description, and are illustrated in the accompanying drawings.

BRIEF DESCRIPTION OF THE DRAWINGS

In the Drawings:

The sole FIGURE is a vertical sectional view illustrating schematically the structure and function of the present apparatus.

DESCRIPTION OF THE INVENTION

The separating apparatus as shown in the FIGURE comprises a vertically arranged feed pipe 1, through which mixed sized bulk granulate material is pneumatically fed (Arrow A) to a separating chamber, formed by a vertically arranged outer housing 2, arranged concentric with the feed pipe. Air carrying small particulate separated matter is sucked from the housing 2 (Arrow B) through a discharge conduit 3. The housing 2 is provided with a flanged lower edge **2*a* formed on an outwardly flared skirt 2*b* which opens into a hopper 4 in which larger sized particulate matter 5 is collected. The hopper is also concentric to and surrounds the lower skirt section 2*b* of the housing substantially above the lower edge 2*a*. The hopper 4 has a funnel shaped bottom, and is provided with a gate or valve for the selective extraction of the material 5**, in conventional manner.

Radially entering the hopper 4, at about the level of the lower edge **2*a* of the housing 2, is an air conduit 6**, through which clean air (Arrow C) is supplied for classification of the material.

The upper wall of the housing and the upper wall of the hopper are closed and sealed, as by welding or otherwise to the feed pipe 1 and housing 2 respectively. It is to be noted that the lower or mouth end **1*a* of the feed pipe is substantially below the radial discharge conduit 3, while the lower end of the housing 2*a* is along the central axis of the air inlet 6**.

The distance between the mouth **1*a* of the feed pipe 1 and the lower edge 2*a* of the housing is defined as the braking stretch L in which the downwardly moving mixture of material, illustrated by arrows 8, fed through the feed pipe 1 contacts the counter flowing air, illustrated by the arrows 9. In the braking stretch L, the light or fine particles are immediately carried on the air flow 9 outwardly of the discharge outlet 3, while the heavy or coarse particles fall through the counter-current air flow 9 into the hopper. The coarse particles are prevented from coming into contact or impact on the housing defining the braking stretch L despite the radial component of movement imparted to them by the inflow air through the inlet 6, by the fact that the conically widened lower skirt section 2***b* of the housing obviates such impact. These particles 7 move radially outward but do not impact the skirt section 2*b*.

Preferably, the length of the conically widened lower skirt section 2*b* of the housing is equal to approximately half (½) the defined braking stretch L. Also, it is preferable that the radial angle of the conical section 2*b* be between 20–30 degrees to the central axis. Thus, the apparatus allows for a braking stretch L considerably longer than in case of a cylindrical skirt section according to the prior art. This reduces the volume and energy requirements for the classifying air (entering through inlet 6) without deterioration of separating quality.

Surprisingly, it has been demonstrated with the present invention that despite a relatively slow velocity of classifying air fed in the area of the cone-shaped skirt section, a sufficient braking and thus sizing effect is obtained, while impacting of the particles of coarse material on the housing wall, is significantly reduced. That is, the radial extent of the chamber is increased by flaring skirt section 2*b*, just in that position where the heavy or coarse particals and the counter-current air stream reach an equilibrium so that the coarse material falls without impact, and thereby does not become entrained with the lighter fines discharging through the upper discharge conduit.

Considering the geometry of the stream of bulk material discharged from the opening of the feed pipe, the conically expanding wall section does not have to extend over the full length of the braking stretch. Rather, it will suffice as a rule, that the conical widening begins only at a distance from the mouth of the bulk material feed pipe equalling about half the length of the braking stretch.

The angle of the cone of the widened wall section depends on the geometrical dimensions of the classifier, and in particular on the ratio of the chamber diameter to the diameter of the bulk material feed pipe, the length of the braking stretch, and the distance of the beginning of the conical expansion from the mouth of the bulk material feed pipe, and on the entry speed of the stream of bulk material. Therefore, while such dimensions may, in practice, vary, it is advantageous that the apex or conical angle of the cone containing the widened wall sections lie, between 20 and 30 degrees.

As a result of the foregoing constructions, the advantages noted earlier, for example, allowing a significant reduction in air volume and energy, avoiding impact of the coarse particles, thus reducing creation of dust, etc., and increasing speed of separation are obtained.

Since variations in structure have been suggested and will be obvious to those skilled in the art, it is intended that the present disclosure be taken as illustrative and not limiting of the scope of the invention.

What is claimed:

1. Apparatus for pneumatically separating mixed granulate material, comprising a vertically disposed housing closed at its top and open at its bottom defining an interior chamber, a collecting hopper concentrically surrounding said housing having a cylindrical wall extending at least in part below the bottom of said housing and having an upper end wall mounted on said housing and a conical bottom wall below said housing for collecting material therein, pneumatic feed means for delivering mixed granulate material to said housing said pneumatic feed means comprising a feed pipe extending concentrically through the top of said housing terminating in a mouth in said chamber below said top and above said bottom, said housing having a side wall section below the mouth of said feed pipe widened conically outward in the direction of said collecting hopper defining a widening space within said housing, an air discharge conduit radially passing through said housing in communication with said chamber above said mouth and an inlet conduit means radially passing through the cylindrical wall of said collecting hopper for introducing air radially into said housing in part impinging on the outer surface of said side wall section and in part being deflected upwardly into the mouth of the conically widened side wall section of said housing, the widening space within said housing between the mouth of said feed pipe and the edge of the conically widened side wall section of said housing preventing said granulate material from being radially impinged thereon and defining a braking stretch in which the downwardly moving particles are contacted by the radial and upward counter moving air to effect classification of said granulate material therein whereby the coarser material falls into said hopper and the finer material is discharged through said discharge conduit.

2. The apparatus according to claim 1, wherein the length of the conically widening wall section is substantially equal to one half of the vertical distance between the mouth of thefeed pipe and the lower edge of said side wall section.

3. The apparatus according to claim 2, wherein the conical angle of said side wall section is between 20 and 30 degrees.

* * * * *